United States Patent [19]

Carter

[11] 4,066,808

[45] Jan. 3, 1978

[54] ADHESIVE APPLYING APPARATUS AND METHOD

[75] Inventor: Sidney T. Carter, Shrewsbury, Mass.

[73] Assignee: A-T-O Inc., Cleveland, Ohio

[21] Appl. No.: 605,726

[22] Filed: Aug. 18, 1975

Related U.S. Application Data

[63] Continuation of Ser. No. 337,579, March 2, 1973, abandoned.

[51] Int. Cl.[2] ..... B05C 1/02; B05D 1/28; B05D 1/36

[52] U.S. Cl. ..... 427/428; 118/221; 118/223; 118/231; 118/262; 156/566; 427/286

[58] Field of Search ..... 118/262, 221, 222, 224, 118/62, 223, 231, 250; 156/566, 578; 101/38 A; 427/286, 428

[56] References Cited

U.S. PATENT DOCUMENTS

| | | | |
|---|---|---|---|
| 1,780,793 | 11/1930 | McLaurin | 427/286 X |
| 2,682,254 | 6/1954 | Nicholson | 118/262 X |
| 2,704,530 | 3/1955 | Nilsen et al. | 118/224 |
| 2,905,141 | 9/1959 | Young | 118/262 X |
| 2,989,940 | 6/1961 | Williams | 118/262 X |
| 3,111,897 | 11/1963 | Vanbuskirk | 118/262 X |
| 3,303,815 | 2/1967 | Silver | 118/262 |
| 3,358,645 | 12/1967 | Caulford et al. | 118/262 |
| 3,623,451 | 11/1971 | Burgess et al. | 118/221 X |
| 3,685,441 | 8/1972 | Aebersold et al. | 101/38 A |

*Primary Examiner*—John P. McIntosh

*Attorney, Agent, or Firm*—Dike, Bronstein, Roberts, Cushman & Pfund

[57] ABSTRACT

Labeling apparatus wherein a rotor rotatable about a vertical axis is provided with peripherally spaced suction pads for taking labels presented thereto in vertical positions, moving them by adhesive-applying rolls for application of adhesive thereto and then pressing them into engagement with the side surfaces of containers supported in vertical positions. The adhesive-applying rolls are supported in substantially vertical positions in tangential relation to the rotor and there are adjustably mounted doctor rolls supported in tangential engagement with the adhesive rolls. The surfaces of the adhesive-applying and doctor rolls have mutually interengaged ribs and grooves and adhesive is supplied to the upper ends of the doctor rolls in free flowing streams so as to flow downwardly over the lateral surfaces of the rolls to their lower ends. A tray at the lower ends provides for collecting the adhesive and returning it to a reservoir for reuse. The doctor rolls are driven at about 1/12 the rate of rotation of the applicator rolls and there are strippers associated with the applicator rolls to prevent the labels from clinging to the applicator rolls. A drive is provided for constantly rotating the adhesive-applying and doctor rolls and a pump is provided for pumping adhesive thereto in sufficient quantity to keep the adhesive-applying rolls and doctor rolls coated at all times with adhesive and to coat the labels as fast as they are presented to the adhesive-applying rolls. Override clutches provide for driving the adhesive-applying rolls at a lower speed and valves provide for controlling the adhesive supplied to the rolls by the pump.

10 Claims, 21 Drawing Figures

ADHESIVE APPLYING APPARATUS AND METHOD

This is a continuation of application Ser. No. 337,579, filed on Mar. 2, 1973 now abandoned.

BACKGROUND OF THE INVENTION

The adhesive-applying apparatus herein illustrated is designed especially for use in conjunction with label-picking and applying apparatus such as shown in my copending applications wherein the labels are presented by a picker to the peripheral surface of a rotor which has peripherally spaced suction pads thereon for holding the labels in upright positions and for movement circularly while so held to a position for application of adhesive thereto by the adhesive-applying means herein illustrated and thereafter to a position for engagement with containers in vertical positions. Adhesive-applying apparatus is, of course, employed for many purposes and various combinations of adhesive-applying rolls, doctor rolls and blades, and the like have been tried to achieve uniform distribution of adhesive with varying degrees of success. The adhesive employed for the purpose of labeling according to this invention is especially designed for applying labels to plastic bottles and containers and is quite watery. Accordingly, it must be applied in such a controlled quantity as not to run after being applied to the surfaces of the labels. Moreover, it cannot be rubbed onto the surfaces of the labels nor should it be rubbed or scraped onto the surfaces of the adhesive-applying rolls since to do so forms particles which are carried around by the rotating surfaces and this produces dry lines on the surfaces of the labels. It is the purpose of this invention to employ adhesive-applying rolls and doctor rolls for the application of adhesive to labels in such a way as to eliminate the difficulties referred to above; to provide an apparatus in which adhesive can be applied in carefully controlled amounts; and to provide an apparatus which can be easily maintained in operating condition for either hot or cold adhesive.

SUMMARY

As herein illustrated, the invention comprises in combination with a support for labels which is arranged to support labels in a substantially perpendicular plane for application to the side surfaces of vertically supported containers, of means for applying adhesive to the surfaces of the labels before they are moved into engagement with the side surfaces of the containers comprising an adhesive-applying roll and a doctor roll mounted adjacent each other for rotation about spaced parallel, substantially vertical axes with the surface of the adhesive-applying roll adjacent the support for the containers, the rolls having intermeshing ribs and grooves of complementary section, means supporting the doctor roll for adjustment relative to the adhesive-applying roll to control the distance between the surfaces of the intermeshing ribs and grooves, means for supplying free-flowing adhesive to the upper end of the doctor roll and collecting it at the lower ends of the roll, and means for driving the rolls at different rates of rotation such that the doctor roll is rotated at a slower rate than the adhesive-applying roll. The peripheral surfaces of the ribs and grooves are cylindrical and of right section and preferably the ribs on the adhesive-applying roll are metal and those on the doctor roll are plastic. The doctor roll is rotated at approximately 1/12 the rate of rotation of the adhesive roll. To provide for all-over coverage of labels two adhesive-applying rolls are arranged side-by-side for successive contact of labels therewith and each is provided with a doctor roll. During labeling the adhesive-applying rolls are driven at a predetermined constant speed and the pump for delivering adhesive to the doctor roll is driven at a speed sufficient to deliver an excess amount of adhesive to the doctor roll. During periods between labeling operations the adhesive-applying roll and doctor roll are driven at a lower speed and there is a valve for controlling the adhesive supplied to the rolls by the pump.

The invention will now be described in greater detail with reference to the accompanying drawings wherein.

Figure 2:
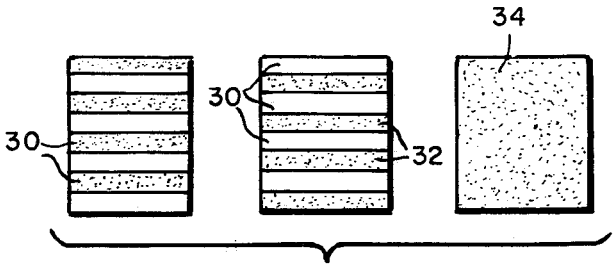
FIG. 2 illustrates the progressive application of adhesive to labels to provide for overall coverage.
Figures 2A, 2B:
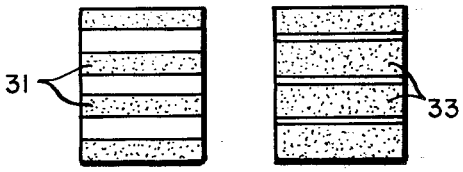
Figure 2C:
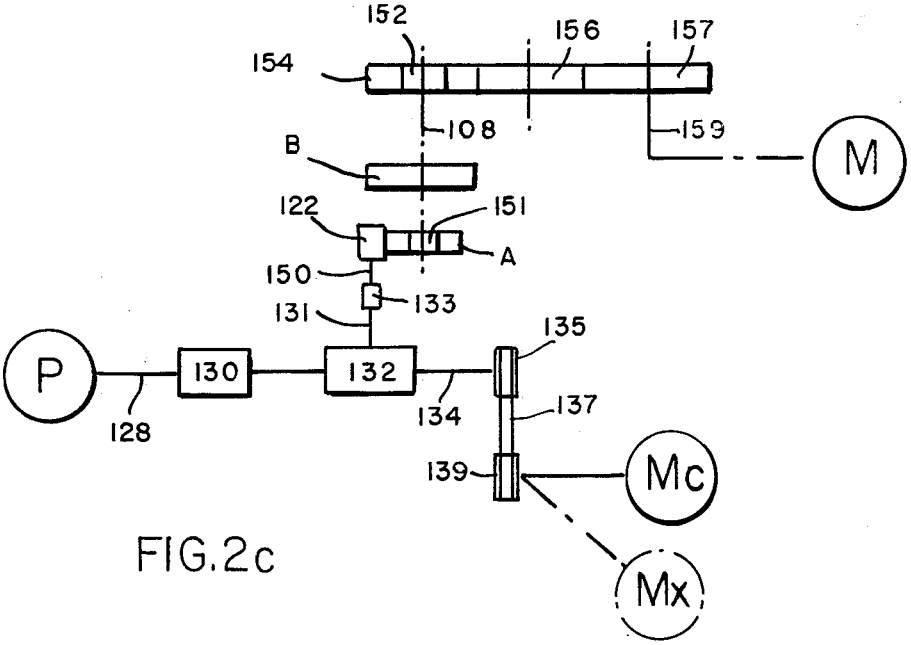
Figure 3:
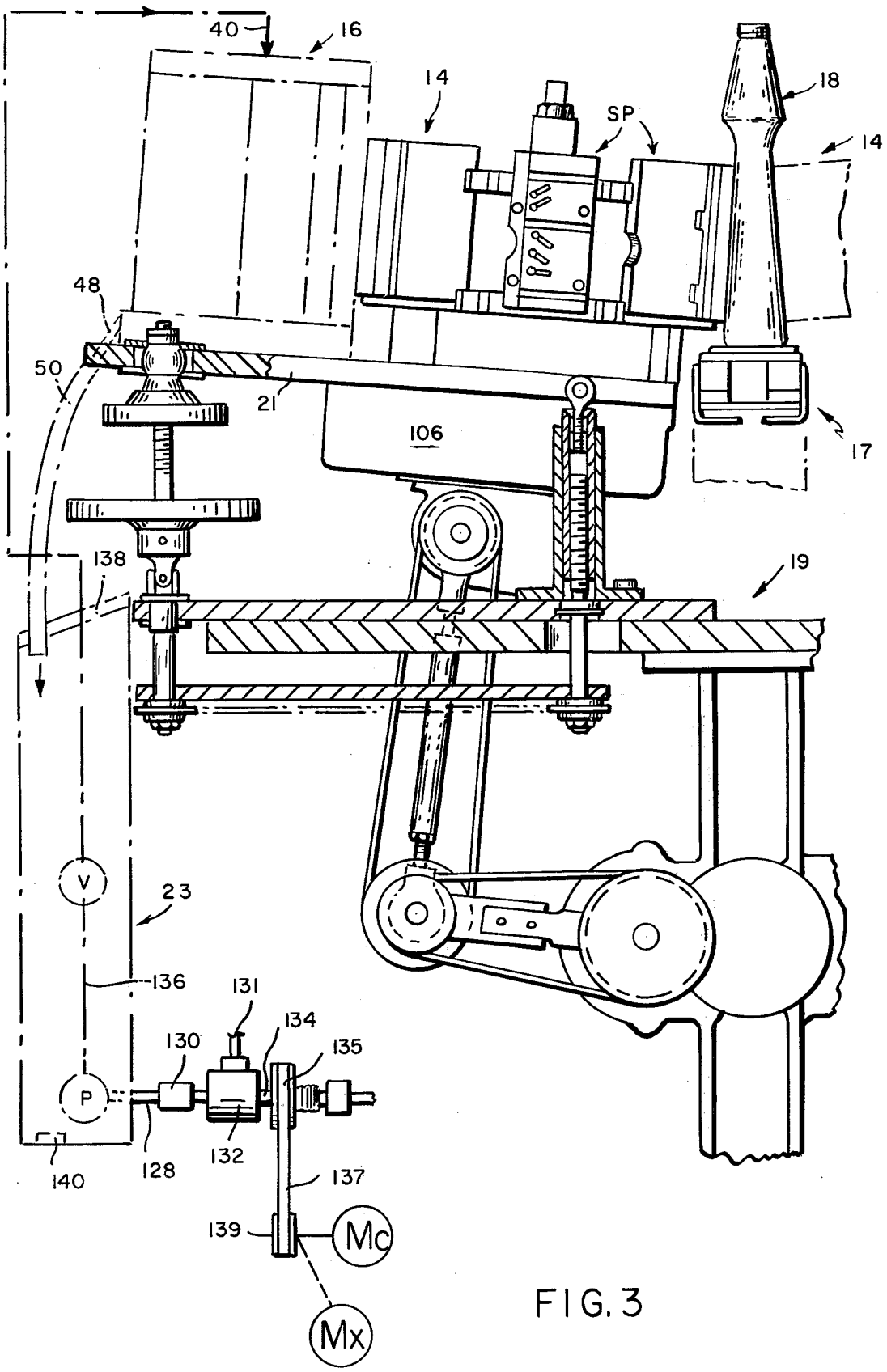
Figure 4:
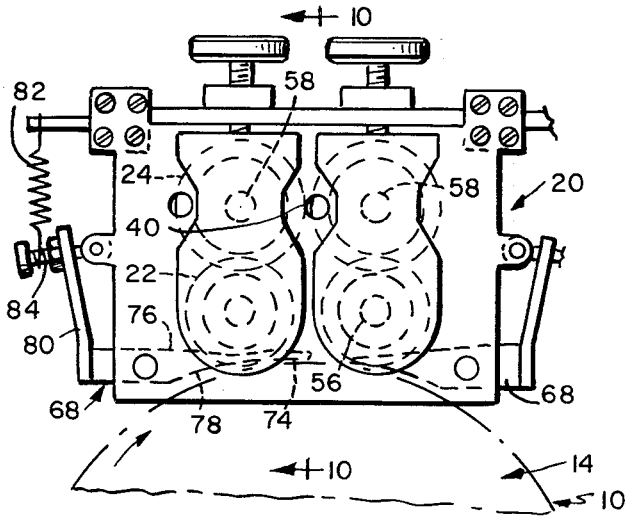
Figure 7:
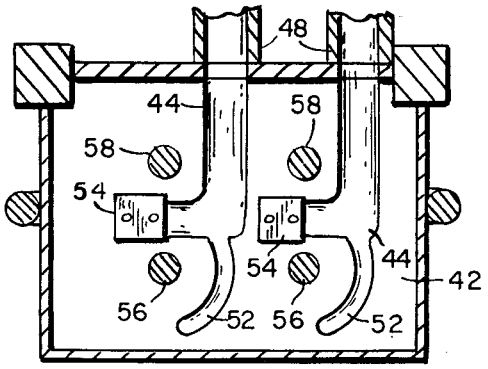
Figure 5:
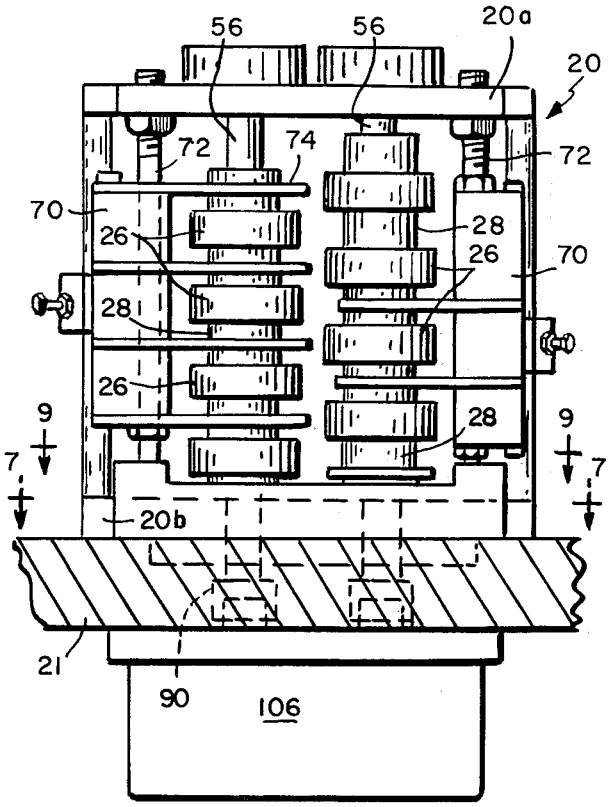
Figure 6:
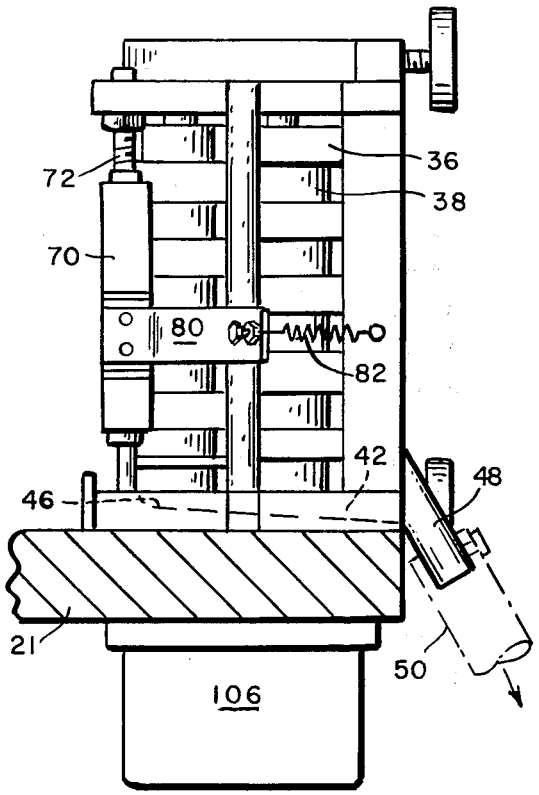
Figure 8:
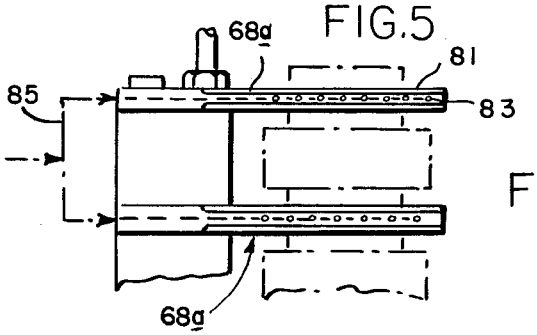
Figure 9:
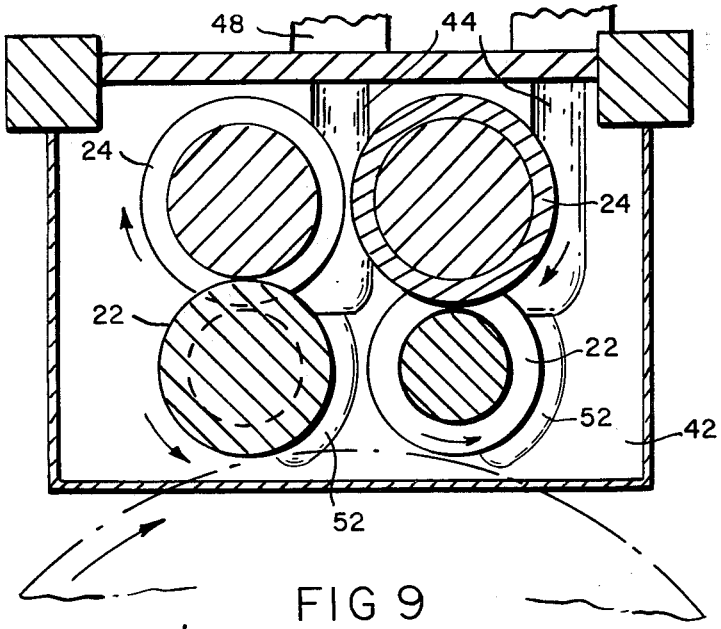
Figure 10:
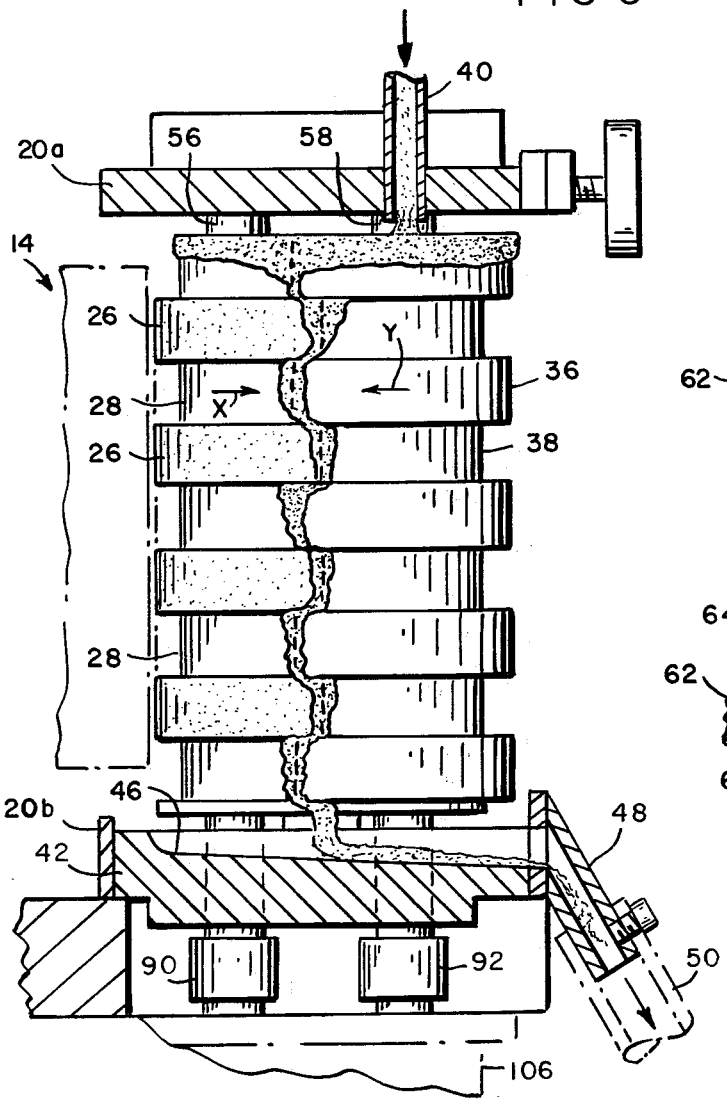
Figure 11:
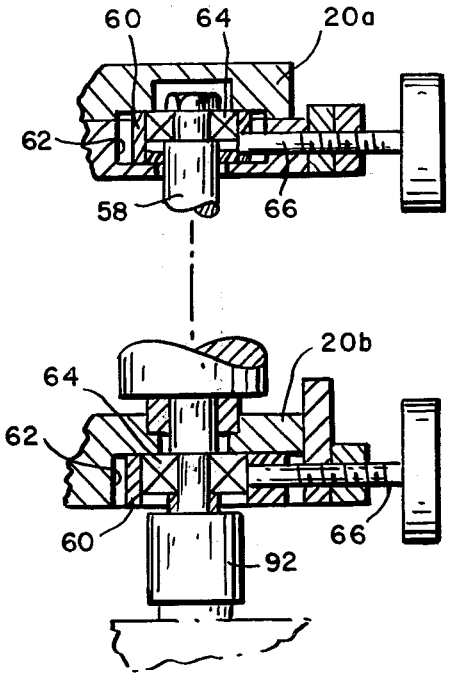
Figures 12, 13:
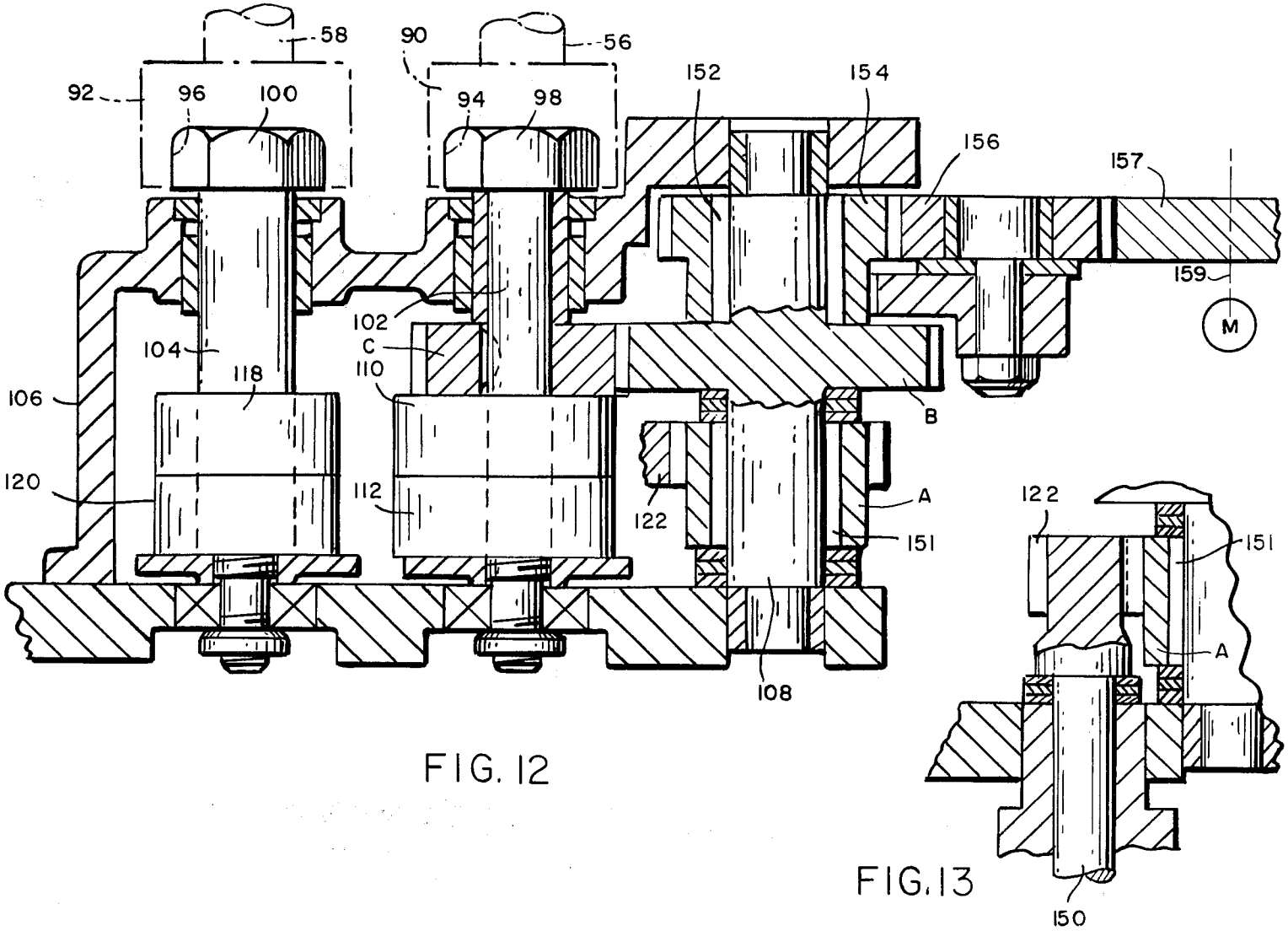
Figure 14:
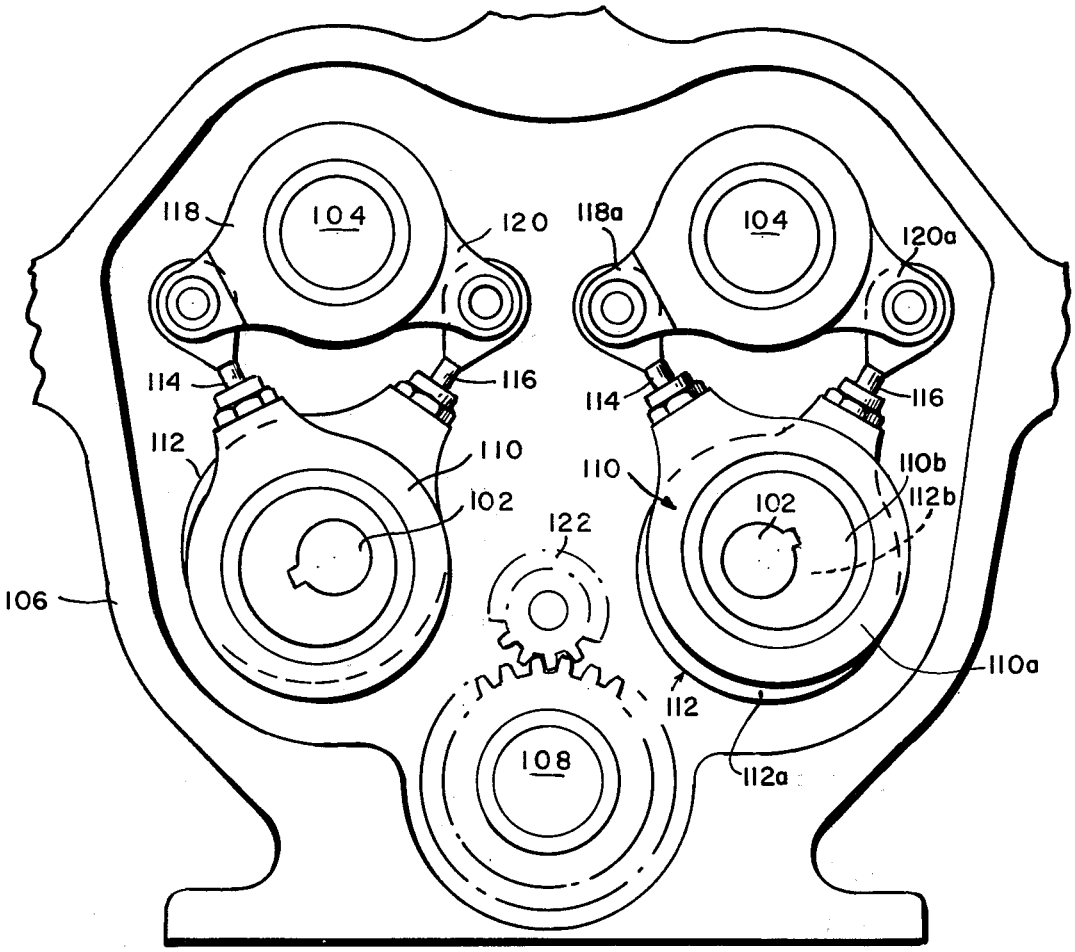

FIG. 2*a* illustrates the application of adhesive in spaced parallel stripes with bare stripes between them of approximately the same width;

FIG. 2*b* illustrates the application of adhesive in spaced parallel stripes with bare stripes between them which are much narrower than the adhesive stripes;

FIG. 2*c* diagrammatically illustrates the drive by means of which the adhesive-applying rolls are driven at normal speed during labeling operations and at a slower speed between labeling operations;

FIG. 3 is an elevation of the label-applying apparatus showing the relation of the adhesive-applying apparatus, rotor and conveyor on which the containers are supported;

FIG. 4 is a plan view showing the adhesive-applying apparatus in relation to the label carrying rotor;

FIG. 5 is an elevation of the label-applying apparatus from the front side showing the arrangement of the label strippers;

FIG. 6 is an elevation as seen from the right side of FIG. 5;

FIG. 7 is a horizontal section taken on the line 7-7 of FIG. 5;

FIG. 8 is a fragmentary front elevation showing a modified form of strippers;

FIG. 9 is an enlarged horizontal section taken on the line 9—9 of FIG. 5 showing the adhesive-applying rolls in relation to the label carrying rotor;

FIG. 10 is an enlarged elevation taken on the line 10—10 of FIG. 4 showing the distribution of the adhesive;

FIG. 11 is a fragmentary view showing the adjustment for the doctor rolls;

FIG. 12 is a section through the drive for the adhesive-applying and doctor rolls;

FIG. 13 is a fragmentary section showing an auxiliary drive for the adhesive-applying and doctor rolls;

FIG. 14 is a plan view of the drive shown in FIG. 12; and

FIGS. 15, 16, 17 and 18 diagrammatically illustrate the drive for turning the doctor roll at about 1/12 the speed of rotation of the adhesive-applying roll.

Figure 1:
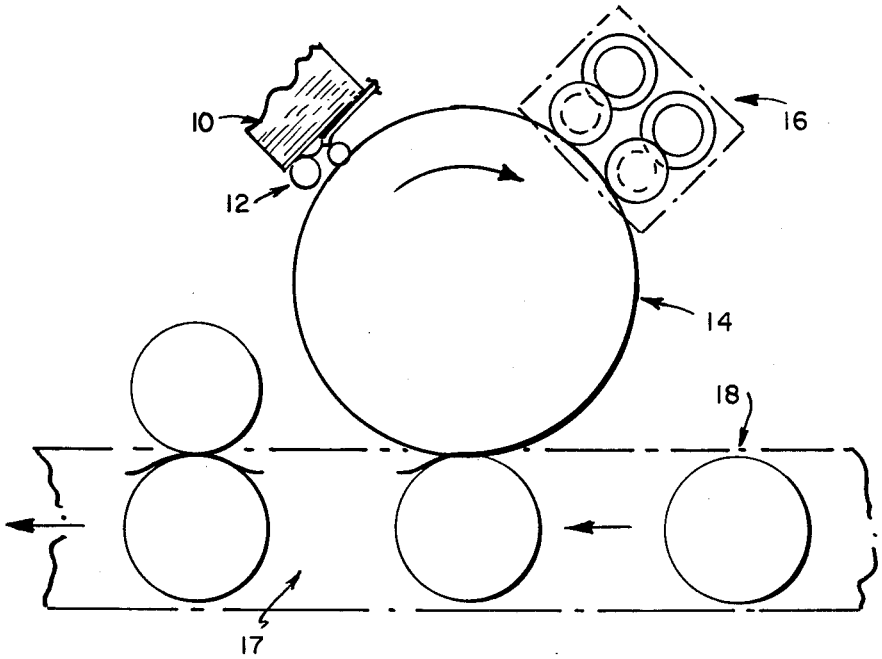
FIG. 1 is a plan view diagrammatically illustrating a rotor arranged to take labels from a magazine, move them to a position for application of adhesive thereto and then apply them to containers travelling along a straight line adjacent to the rotor.

In my application Serial No. 308,280, filed Nov. 20, 1972, now U.S. Pat. No. 3,806,114 there is shown a pneumatic picker for taking labels from a magazine and transferring them to a rotor on which there are peripherally spaced vacuum pads for holding the labels in substantially vertical positions for movement thereby to a place for application of adhesive and from thence to a place for application to the sides of bottles or containers transversely along in a single file on a conveyor. This application relates specifically to the adhesive-applying means at the place for application of adhesive and FIG. 1 diagrammatically illustrates the arrangement of the label magazine 10, picker 12, rotor 14, adhesive-applying apparatus 16 and containers 18 travelling along adjacent the rotor on a conveyor 17. While, as illustrated in FIG. 1, the labels are applied to one side only of the containers the apparatus, according to this invention, is duplicated on both sides of the conveyor 17 (FIG. 3) on which the containers are travelling so that labels are applied to both sides of the containers simultaneously. Since such apparatus is identical on each side only that on one side will be described herein.

The conveyor 17 (FIG. 3) is supported in a horizontal position above the frame of the labeler, a portion 19 of which is shown in FIG. 3, and the rotor and adhesive-applying apparatus 14 and 16 are mounted on a table 21 which is supported on the frame so that it may be tilted to adjust the peripheral surface of the rotor into parallelism with the side surfaces of the containers on the conveyor.

Referring specifically to the adhesive-applying apparatus, FIG. 4 in plan view shows the top of a supporting frame 20 which supports two pairs of rolls, each comprising an adhesive-applying roll 22 and a doctor roll 14 in substantially vertical positions for rotation about substantially vertical axes with the surfaces of the adhesive-applying rolls substantially tangent to the peripheral surface of the rotor 14 which, as previously mentioned, carries the labels along a circular path from the picker 12 to the adhesive-applying apparatus and from thence to the containers. FIG. 5 shows the adhesive-applying and doctor rolls in elevation supported within the frame 20. The adhesive-applying rolls 22 are provided with alternately arranged ribs 26 and grooves 28 and in the adjacent adhesive-applying rolls the ribs alternate with the grooves. The peripheral surfaces of the ribs are substantially tangent to the surface of the rotor 14 (FIG. 4) and it is these surfaces which apply the adhesive to the labels supported by the rotor. The adhesive is applied by the first of the adhesive-applying rolls to the surface of the labels shown at the left of FIG. 2 in a series of spaced parallel stripes 30 and then by the second of the adhesive-applying rolls in a series of spaced parallel alternate stripes 32 thus providing an overall coating 34, as shown at the right of FIG. 2. It is within the scope of the invention to employ only one adhesive-applying roll so that the label will have the adhesive applied thereto in a series of spaced parallel stripes 31 (FIG. *2a*). Also it is within the scope of this invention to vary the axial width of the ribs and grooves to make them narrower or broader, as shown in FIG. *2b*, wherein the broader stripes 33 are adhesive.

The doctor rolls 24 are provided with ribs and grooves 36 and 38 which mate with the ribs and grooves 26, 28 of the adhesive-applying rolls, as shown in FIGS, 4, 6 and 10. The adhesive-applying rolls are comprised of all metal construction whereas the doctor rolls have metal cores on which are fixed plastic ribs. The ribs and grooves on both the adhesive-applying rolls and doctor rolls are cylindrical and of right section.

The supporting frame 20 has top and bottom plates 20*a*, 20*b* and at the top there is mounted a nozzle 40 (FIG. 10) for delivering adhesive through the top plate 20*a* to the upper ends of the doctor rolls. The nozzle 40 is supported approximately midway between the doctor rolls, as shown in FIG. 4, so that the adhesive flows onto the upper ends of the doctor rolls approximately on a line passing through the centers of these rolls and midway between the centers. The adhesive thus allowed to flow downwardly onto the upper ends of the doctor rolls spreads over their upper surfaces and flows gravitationally downwardly over their peripheral surfaces toward their lower ends and simultaneously is carried around by their rotating surfaces into engagement with the surfaces on the adhesive-applying rolls. The course of the adhesive as it flows downwardly over the surfaces of the rolls is illustrated somewhat diagrammatically in FIG. 10, — the shaded areas representing the downwardly flowing strea of adhesive before it becomes distributed in a uniform film on the surfaces, that is, where the surfaces of the adhesive-applying roll and doctor roll are travelling toward each other indicated by the arrows X and Y (FIG. 10).

The adhesive flows from the upper ends of the rolls to the lower ends and is collected at the lower ends and returned to a reservoir for reuse. Collection of the adhesive at the lower ends of the rolls is provided for by a tray 42 formed in the lower frame plate 20*b* (FIGS. 5, 6, 9 and 10) which has in it a pair of channels 44—44, each of which has an inclined bottom 46 so that adhesive draining into the tray flows laterally from the front side of the tray rearwardly into the upper ends of coupling elements 48—48 connected to the upper ends of flexible conductors 50—50, the lower ends of which are connected to an adhesive reservoir 23 supported on the frame of the labeling apparatus below the adhesive-applying rolls, as shown in FIG. 3. A pair of arcuate grooves 52—52 are formed in the tray in concentric relation to the lower ends of the adhesive-applying rolls for conducting adhesive from the lower ends of these rolls into the channels 44—44 and a pair of scraper blocks 54—54 (FIG. 7) are mounted midway between the lower ends of the rolls of each pair of rolls for scraping adhesive from the lower ends into the channels and grooves.

The adhesive-applying rolls are supported by substantially vertically disposed shafts 56—56 rotatably fixed in the upper and lower frame plates 20*a*, 20*b* and the doctor rolls are supported by substantially vertically disposed shafts 58—58 rotatably and adjustably mounted in the upper and lower frame plates 20*a*, 20*b*. As illustrated in FIG. 11 the adjustment of the doctor rolls is provided for by bearing blocks 60 mounted in recesses 62 formed in the upper and lower frame plates 20*a*, 20 *b* within which the upper and lower ends of the shaft are rotatably supported in antifriction bearings 64 and by screws 66 threaded into the frame plates and rotatably connected to the bearing blocks so that by rotation the shafts 58—58 may be moved relative to the adhesive-applying rolls to adjust the surfaces of the doctor rolls into parallelism therewith and a predetermined distance therefrom.

As was pointed out earlier the labels are held to the peripheral surface of the rotor 14 by suction pads SP (FIG. 3) which are distributed peripherally thereof and in order to prevent application of adhesive to these pads in the event that a label is not presented to a specific pad as the latter travels by it the pad is arranged to be pivoted away from the adhesive-applying apparatus as will be described in greater detail in my pending application.

Assuming, however, that a label is properly supported by a pad it is desirable to insure that it remains on the pad and not be pulled off and becomes wrapped around one of the adhesive-applying rolls by the adhesion of the adhesive. To this end there are provided stripper fingers 68 between the successive ribs or some of them as illustrated in FIGS. 4, 5 and 6. The stripper fingers 68 are attached to pivotally mounted posts 70 supported for pivotal movement on vertically disposed spindles 72 fixed at their upper and lower ends in the frame plated 20*a*, 20*b*. Each stripper finger has a slender blade 74, the rear side 76 of which is substantially straight and substantially tangent to the bottom of the groove within which it is disposed and the front side 78 of which is arcuate and substantially concentric with the surface of the rotor 14. Each post has attached to it an arm 80 to which there is connected a spring 82 for yieldably urging the stripper fingers toward the rotor. A limit screw 84 provides for setting the fingers at a predetermined distance from the surface of the rotor so as not to rub on the surface. As thus provided a label moving in engagement with the adhesive-applying roll is held against the surface of the rotor in spite of the tendency for the adhesive to pull it off.

The stripper fingers 68, shown in FIGS. 4, 5, and 6, have one disadvantage in that in spite of the adjustment provided to keep them out of contact with the surface of the rotor adhesive does accumulate at their ends and may be transferred to the surface of the pads on the rotor. To avoid this alternative stripper means is shown in FIG. 8 in which the fingers 68*a* are mounted in the same manner as shown in FIGS. 3 and 4 and have lengthwise thereof interior passages 81 and orifices 83 in their forward faces connected to the passage 81 through which jets of air are adapted to be ejected to hold the label against the surface of the rotor. With this arrangement the stripper fingers need not be held as close to the surface of the rotor and so if there is any accumulation of adhesive at their ends it will not be transferred to the pads. The fingers 68*a* are connected to a source of air pressure indicated generally at 85.

To insure proper distribution of the adhesive on the surface of the adhesive-applying rolls it has been found desirable to rotate the doctor rolls slower than the adhesive-applying rolls about 1/12 the rate of rotation of the adhesive-applying rolls and this is achieved herein by the drive illustrated in FIGS. 12 to 18 inclusive. Referring to FIGS. 5, 10, 11 and 12 the lower ends of the shafts 56—56 and 58—58 have fixed thereto coupling members 90—90 and 92—92 which contain hexagonal openings 94—94 and 96—96 for telescopically receiving the heads 98—98 and 100—100 at the upper ends of vertically disposed shafts 102—102 and 104—104 journaled at their upper and lower ends in a housing 106 mounted to the underside of the table 21. The housing 106 also supports a vertically mounted shaft 108 (FIG. 12) on which there are mounted a gear A, a gear B and a gear 154. The gear B is fixed to the shaft 108 and the gears A and 154 are mounted thereon by means of overriding clutches 151 and 152 so that the shaft 108 and hence the gear may be driven either by way of the gear A or the gear 154. The gear B meshes with two gears C-C, one on each of the shafts 102—102. The shafts 102—102 each have mounted thereon two eccentrics 110 and 112 (FIGS. 12 and 14) which are connected by links 114 and 116 to clutches 118 and 120, the latter being mounted on the shafts 104—104.

Figure 15:
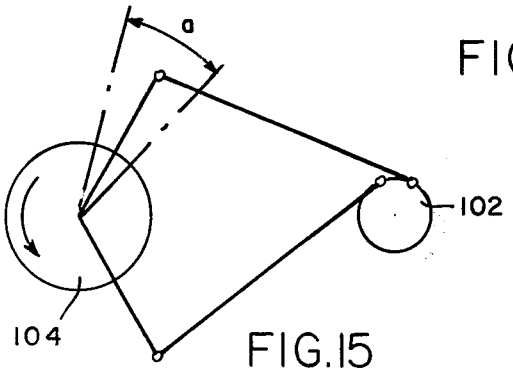
Figure 16:
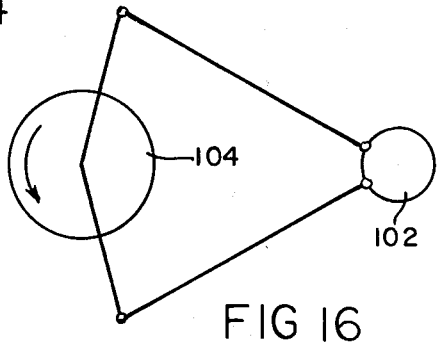
Figure 17:
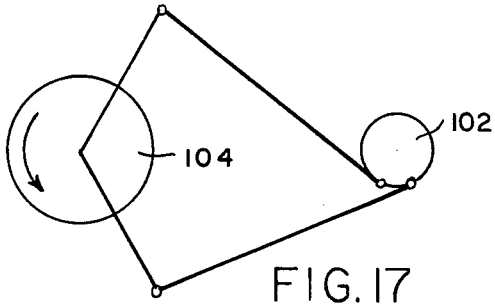
Figure 18:
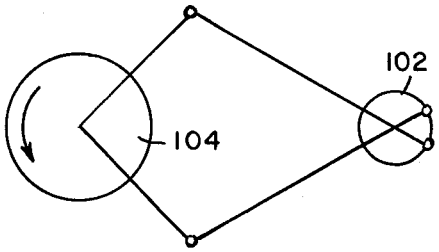

The eccentrics 110,112 comprise rings 110*a* and 112*a* mounted on eccentric disks 110*b* and 112*b* keyed to the shaft 102, 60° apart. The rod 14 is connected to ring 110*a* and the rod 116 is connected to ring 112*a*. Hence, rotation of the shaft 102 will cause the rods 114,116 to moe in the same direction, but at opposite sides of the center line of the shaft 104. Thus, when the rod 116 is pushing the arm 120 counterclockwise, the rod 114 is not pushing the arm 118*a* because the clutch 118 is turning freely on the shaft 104. At the end of the eccentric throw, the rods 114,116 are moved in the opposite direction about the center line of the shaft 102 and, in doing so, the rod 114 pulls the arm 118*a* in a counterclockwise direction, while the rod 116 does nothing. Thus, the shaft 104 is continuously driven in one direction, that is, counterclockwise. The throw of the eccentrics is such as to rotate the shaft 104 at a rate which is 1/12 that of the shaft 102. The one-way clutches commonly known as overrunning clutches are Torrington Drawn Cup Roller Clutches manufactured by the Torrington Company/Bearings Division, Torrington, Connecticut. The shafts 102—102, to the upper ends of which the adhesive-applying rolls are coupled, are rotated constantly and the shafts 104—104, the upper ends of which are connected to the doctor rolls, are rotated intermittently by the eccentrics and clutches. Diagrammatically the intermittent rotation of the doctor rolls is represented in FIGS. 15 and 18. The clutches are overrunning or single direction construction and the travel of the eccentrics is represented by the arcuate line marked *a*. With this travel for each complete rotation of the shafts 102—102 the shafts 104—104 are advanced 1/12 of a revolution. 132 of It is desirable to drive the adhesive-applying rolls and doctor rolls constantly and to continuously recirculate the adhesive whenever the label-applying apparatus is in operating condition even though at times containers are not being run through the labeling machine for application of labels thereto, in order to prevent the adhesive from setting up and hardening on the surfaces of the adhesive-applying and doctor rolls and of setting up in the reservoir, pump and nozzle by means of which it is supplied to the adhesive-applying rolls. As herein illustrated, the reservoir 23 (FIGS. 2*c* and 3) is supported on the frame of the machine below the adhesive-applying rolls and has mounted internally near the bottom a gear pump P provided with a drive shaft 128 which extends through the back side of the reservoir and is connected by a coupling 130 to a gear box 132. The gear box 132 is provided with a shaft 134 on which is fixed a pulley 135. A belt 137 is entrained about the pulley 135 and a pulley 139 fixed to the shaft of a constant speed motor M*c*. The motor M*c* drives the pump P at a constant speed at all times which is slower than the normal slow speed of the machine. The pump as thus driven is geared to pump more adhesive than is required to apply adhesive to the labels and to provide extra volume to keep the adhesive circulating. A conductor 136 connected at its lower end to the rotary gear pump extends upwardly through a cover 138 at the top of the reservoir. The upper end of the conductor is connected to the nozzle 40, as shown in FIG. 10, above the upper ends of the rolls. The return conductors 50—50, also shown in FIG. 10, extend through the cover 138 into the reservoir, allowing the excess adhesive to be returned to the bottom of the reservoir for recirculation. A by-pass valve V is provided in the conductor 136 from the pump and is adjusted to supply sufficient adhesive to keep the rolls 22—22 and 24—24 covered and flowing back through the conductors 50—50 when the labeler is running at top speed and applying adhesive to all of the labels. That is, there is sufficient adhesive supplied through the nozzle 40 to apply adhesive to each label and to provide for a surplus which flows back to the reservoir 23. The pump P has a capacity so that it always pumps more adhesive than is required to keep the adhesive circulating and for applying adhesive to all of the labels. When the labeler is stopped or is running at slow speed there is less adhesive being applied or none at all. Hence the volume of adhesive circulating increases. Under ordinary conditions the returns 50—50 are sufficient to return the excess volume of adhesive. However, since the adhesive may thicken from constant circulation and at times labels may be employed which require a more viscous adhesive, the return could become filled up when not labeling. Accordingly, a two speed motor M*x* may be substituted for the motor M*c;* for example a motor which will run at top speed and at half speed. When using a motor it is electrically connected so that when the labeler is running at top speed the motor M*x* will be running at top speed and the labeler stops the motor M*x* will be running at half speed. This will keep the adhesive rolls turning and will also cut down the volume of adhesive being pumped so that there will be no increase in circulation.

When the machine is shut down for any length of time the adhesive in the reservoir is drained out at the bottom through a drain plug 140 whereupon water is pumped through the system so as to circulate down over the rolls and wash out all traces of adhesive.

When no labels are being applied it is desirable to drive the adhesive-applying rolls and doctor rolls at a lower speed and this is provided for by the motor M*c* (FIGS. 2*c* and 3) by way of the gear box 132, a shaft 131 extending therefrom and a coupling 133 which connects the shaft 131 to the shaft 150. The shaft 150, as illustrated in this figure and also in FIGS. 12 and 13, has on it a gear 122 which meshes with the gear A. When the main drive shaft of the labeler is not running the shaft 108 is driven by the motor M*c* through the train related, -the clutch 152 allowing the shaft 108 to turn within the gear 154. When the main shaft is being driven, as when a labeling process is underway, the gear 154 is driven by a meshing gear 156 which in turn is driven through gear 157 from the rotor shaft 159. The rotor shaft is driven by a motor M. When the rotor shaft is rotating the gear 154 the latter through its associated clutch 152 drives the shaft 108 and the clutch 151 associated with the gear A allows the shaft 108 to turn within the gear A.

An important aspect of the apparatus, as herein illustrated, resides in the application of the adhesive to the adhesive-applying rolls without rubbing, scraping or squeezing and this is achieved by adjusting the doctor rolls close to but not touching the surfaces of the adhesive-applying rolls, the proximity of the surfaces being determined by the viscosity of the adhesive and by delivering the adhesive to the upper ends of the doctor rolls so that it flows freely downwardly over their surfaces. The rotating doctor rolls carry the adhesive around onto the surfaces of the adhesive-applying rolls, metering it to a thickness corresponding to that of the gap between the rolls without rubbing or squeezing it onto the surfaces and the intermittent rotation of the doctor rolls prevents excessive accumulation at the ingoing sides of the rolls so that globs of adhesive are not formed on the surfaces of the adhesive-applying rolls. While, as herein illustrated, the doctor rolls are rotated at a lower speed than the adhesive-applyig rolls, about 1/12 the rate of rotation of the adhesive-applying rolls, it is within the scope of the invention to change the rate of rotation as determined by the need for adhesive and the viscosity of the adhesive employed.

It should be understood that the present disclosure is for the purpose of illustration only and that this invention includes all modifications and equivalents falling within the scope of the appended claims.

I claim:

1. The method of overall coating of labels supported on a rotor for rotation about a predetermined vertical axis so that the surfaces of the labels to be coated are substantially vertical, comprising rotating the rotor so as to move the labels successively along a predetermined circular path relative to a pair of applicator rolls supported for rotation about vertical axes parallel to the axis of the rotor, the rolls of the pair of rolls being spaced along said path of movement in substantially tangential relation to said path, at the first applicator roll applying adhesive to vertically spaced parallel areas of the labels at the place of application and as the leading end of the label leaves the place of tangency of the applicator roll with the rotor stripping it away from the surface of the applicator roll so that it remains on the surface of the rotor and at the second applicator roll applying adhesive to the vertically spaced areas of the labels between the areas previously coated and stripping the leading end of the totally coated label away from the surface of the second applicator roll so that it remains on the surface of the rotor.

2. The method of overall coating of labels comprising vacuum holding the labels to be coated to a rotor for rotation about a predetermined axis, rotating the rotor so as to move the labels successively along a predetermined circular path relative to a pair of applicator rolls supported for rotation about axes parallel to the axis of the rotor, the rolls of the pair of applicator rolls being spaced along said path of movement in substantial tangential relation thereto, at the first applicator roll applying adhesive to spaced parallel areas of the labels and as the leading ends of the labels leaves the place of tangency of the applicator roll with the rotor leading them away from the surface of the applicator roll so that they remain in engagement with the surface of the rotor and at the second applicator roll applying adhesive to the spaced areas of the labels between the areas previously coated and leading the leading ends of the totally coated labels away from the second applicator roll so that they remain in engagement with the surface of the rotor.

3. The combination with a rotor rotatable about a vertical axis, said rotor having a peripheral surface on which labels are supported in a predetermined plane for application to the side surfaces of vertically supported containers, means for applying adhesive to said labels as the rotor turns relative thereto, said means comprising a pair of applying rolls, shafts supporting the applying rolls for rotation on axes spaced from and parallel to the axis of rotation, said applying rolls being spaced peripherally to the rotor with their surfaces substantially tangent thereto, said surfaces having axially spaced peripheral ribs and grooves so arranged that the ribs of one of the rolls are opposite the grooves of the other of the rolls so as to successively apply spaced bands of adhesive to the surfaces of the labels which collectively constitute an overall coating of the labels, a doctor roll and shaft supporting it adjacent each applying roll with its surfaces substantially tangent but not touching the surface of the applying roll, said doctor roll having axially spaced ribs and grooves so arranged that the ribs on the applying roll alternate with the ribs of its associated doctor roll, a conductor supported above the upper end of each doctor roll for gravitational delivery of adhesive to the upper end as the doctor roll rotates so that the adhesive flows from the upper end outwardly and downwardly onto the peripheral face of the doctor roll and gravitates to the lower end, means for rotating the shaft supporting the doctor rolls so that the surfaces of the applying rolls remove adhesive from the surfaces of the doctor rolls at such a rate as to prevent accumulation of adhesive at the bites of the rolls and to spread the adhesive thinly on the surface of the applicator rolls, and elongate stripper fingers supported in the grooves in the adhesive-applying surfaces of the adhesive-applying rolls for holding the labels on the surface of the rotor during application of adhesive thereto.

4. Apparatus according to claim 3, wherein fixed bearings support the ends of the applying rolls and movable bearings support the ends of the doctor rolls, and there is means for adjusting the movable bearings to in turn adjust the proximity of the tangentially arranged surfaces of the rolls relative to each other.

5. Apparatus according to claim 3, wherein the applying rolls are driven and there is means drivably connecting each of the applying rolls to its associated doctor roll operable to effect rotation of the doctor roll substantially constantly but at a rate of substantially 1/12 the rate of rotation of the applying roll.

6. Apparatus according to claim 3, comprising oppositely operable one-way clutch means drivingly mounted to each doctor roll and eccentric means drivingly mounted to each applying roll, said clutch means being operable by said eccentric means alternately to effect operation of first one clutch and then the other.

7. Apparatus according to claim 3, wherein the stripper fingers have orifices at the sides confronting the rotor through which jets of air are maintained and there is means for supporting said stripper means spaced from the surfaces of the rotor.

8. In a labeling machine of the kind described, adhesive applying means comprising substantially vertical and parallel adhesive applying rolls and doctor rolls, a pump for supplying adhesive to the upper ends of the doctor rolls for distribution onto the surfaces of the adhesive applying rolls, drivable means for rotating the adhesive applying rolls, a high speed shaft, a low speed shaft and means connecting the high and low speed shafts to said drivable means, said last means operating when the high and low speed shafts are rotating to transmit the rotation of the high speed shaft to the drive means and when the high speed shaft is not rotating to transmit the rotation of the low speed shaft to said drive means.

9. Apparatus according to claim 8, wherein the low speed shaft is rotated continuously and the high speed shaft is rotated only when a label operation is in progress.

10. Apparatus according to claim 9, wherein a pump is provided for supplying adhesive to the doctor rolls and there is means connecting the pump to the low speed shaft for continuous operation.

* * * * *